US008066156B2

(12) United States Patent
Schiff et al.

(10) Patent No.: US 8,066,156 B2
(45) Date of Patent: Nov. 29, 2011

(54) BEVERAGE DISPENSING DEVICE

(75) Inventors: David R. Schiff, Highland Park, NJ (US); Larry R. Trunek, Mukwonago, WI (US); Jennifer E. Shrout, Milwaukee, WI (US)

(73) Assignee: MillerCoors LLC, Wilmington, DE (US)

( * ) Notice: Subject to any disclaimer, the term of this patent is extended or adjusted under 35 U.S.C. 154(b) by 716 days.

(21) Appl. No.: 12/124,868

(22) Filed: May 21, 2008

(65) Prior Publication Data

US 2009/0289085 A1 Nov. 26, 2009

(51) Int. Cl.
*B65D 83/00* (2006.01)

(52) U.S. Cl. ..... 222/396; 222/3

(58) Field of Classification Search ..... 222/396, 222/399, 394, 402.1–402.25, 401, 402, 395, 222/3, 187, 190; 239/333, 339, 340, 346, 239/373

See application file for complete search history.

(56) References Cited

U.S. PATENT DOCUMENTS

| | | | | |
|---|---|---|---|---|
| 4,049,158 | A | | 9/1977 | Lo et al. |
| 4,182,688 | A | | 1/1980 | Murtaugh |
| 5,011,047 | A | | 4/1991 | Cruysberghs |
| 5,022,565 | A | | 6/1991 | Sturman et al. |
| 5,032,619 | A | | 7/1991 | Frutin et al. |
| 5,102,627 | A | | 4/1992 | Plester |
| 5,115,841 | A | | 5/1992 | Horino et al. |
| 5,186,902 | A | | 2/1993 | Plester |
| 5,188,257 | A | | 2/1993 | Plester |
| 5,234,140 | A | | 8/1993 | Demarest et al. |
| 5,270,069 | A | | 12/1993 | Plester |
| 5,285,931 | A | * | 2/1994 | Alfons ..... 222/61 |
| 5,301,851 | A | | 4/1994 | Frutin |
| 5,308,631 | A | | 5/1994 | Anglerot |
| 5,350,587 | A | | 9/1994 | Plester |
| 5,368,207 | A | | 11/1994 | Cruysberghs |
| 5,398,850 | A | | 3/1995 | Sancoff et al. |
| 5,443,186 | A | | 8/1995 | Grill |

(Continued)

FOREIGN PATENT DOCUMENTS

EP 0195692 9/1986

(Continued)

OTHER PUBLICATIONS

PCT Search Report and Written Opinion for PCT/US2009/043785.

(Continued)

*Primary Examiner* — Lien Ngo
(74) *Attorney, Agent, or Firm* — Quarles & Brady LLP

(57) ABSTRACT

A beverage dispensing device using a pressure regulator to maintain the pressure inside the beverage container as the beverage is dispensed is disclosed. The pressure regulator includes a second chamber separate from the space containing the beverage. The second chamber contains a sorbent on which a propellant gas is adsorbed. The pressure inside the beverage container controls the opening and closing of a flow regulator that allows either the beverage being dispensed or a displacing agent contained in a third chamber to flow into the second chamber when the pressure in the beverage container is decreased. If either the beverage or the displacing agent flow into the second chamber, it will liberate the propellant gas adsorbed to the sorbent, and the gas is released through an outlet into the beverage container. This increases the pressure in the beverage, which in turn closes the flow regulator and stops the liberation of the propellant gas from the sorbent. This process is repeated as the beverage is being dispensed to maintain the pressure of the beverage inside the dispenser.

25 Claims, 4 Drawing Sheets

U.S. PATENT DOCUMENTS

| | | | | |
|---|---|---|---|---|
| 5,562,235 | A | 10/1996 | Cruysberghs | |
| D405,931 | S | 2/1999 | Palmer | |
| 5,992,700 | A | 11/1999 | McGlothlin et al. | |
| 6,039,222 | A | 3/2000 | Smith | |
| 6,053,475 | A | 4/2000 | Batschied et al. | |
| 6,260,823 | B1 | 7/2001 | Weber | |
| D454,467 | S | 3/2002 | Magermans et al. | |
| 6,360,923 | B1 * | 3/2002 | Vlooswijk | 222/399 |
| 6,412,668 | B1 | 7/2002 | Vlooswijk et al. | |
| 6,708,844 | B2 | 3/2004 | Lim et al. | |
| 6,745,922 | B1 * | 6/2004 | Vlooswijk et al. | 222/399 |
| 7,077,298 | B2 | 7/2006 | Vlooswijk et al. | |
| 7,185,786 | B2 | 3/2007 | Krause et al. | |
| D551,895 | S | 10/2007 | Allen et al. | |
| D558,950 | S | 1/2008 | Brans | |
| D560,873 | S | 1/2008 | Brans | |
| D560,874 | S | 1/2008 | Brans | |
| 2005/0230415 | A1 | 10/2005 | Forgac et al. | |
| 2006/0049215 | A1 | 3/2006 | Lim et al. | |
| 2006/0272537 | A1 | 12/2006 | Garrett | |

FOREIGN PATENT DOCUMENTS

| | | |
|---|---|---|
| EP | 0312078 | 4/1989 |
| FR | 2690142 | 10/1993 |
| GB | 1542322 | 3/1979 |
| WO | 9517340 | 6/1995 |
| WO | 9947451 A1 | 9/1999 |

OTHER PUBLICATIONS

European Patent Office Machine Translation of French Patent Publication No. 2690142.

* cited by examiner

BEVERAGE DISPENSING DEVICE

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The invention relates to devices for dispensing carbonated beverages.

2. Description of the Related Art

For many years, beer and other carbonated beverages have been available in kegs having a valve assembly. To dispense the beverage from the keg, a dispensing device is inserted into the keg valve assembly, typically through use of threaded mating parts, and a probe at the insertion end of the dispensing device depresses a valve permitting the flow of a pressurizing gas into the keg and the flow of the beverage out of the keg to a suitable dispensing tap.

In commercial establishments, one type of dispensing device uses pressurized carbon dioxide gas from a container to pressurize the keg. Of course, bulky pressurized gas containers are not practical for consumer use and therefore, portable dispensing devices that use a hand powered air pump to pressurize the container have been developed for consumer use. While these portable consumer dispensing devices are easy to use, they do have certain disadvantages. For instance, consumer dispensing devices are often too expensive to justify purchase by a consumer. Also, when the consumer dispensing device is provided by a beverage retailer with a keg, the consumer may face rental and/or deposit fees, and the consumer will need to make a separate trip to return the dispensing device to the beverage retailer. Furthermore, consumer dispensing devices typically use air to pressurize the keg such that the oxygen in air is introduced into the beer thereby limiting the shelf life of the beer due to oxidation.

Due to the drawbacks associated with these consumer dispensing devices, alternative beverage dispensing devices have been proposed. For example, U.S. Pat. No. 6,360,923 describes a device for storing and dispensing carbonated beverages such as beer. One version of the device has a fluid compartment and a propellant compartment which is housed in the fluid compartment. The fluid compartment and a propellant compartment are placed in fluid communication through a pressure control means. The pressure control means delivers propellant (typically carbon dioxide) from the propellant compartment to the fluid compartment as the beverage is withdrawn from the fluid compartment to maintain a desired excess equilibrium pressure of the propellant in the headspace of the fluid compartment. The beverage is discharged from the fluid compartment by way of a dip tube connected to a dispensing means.

Even though various different beverage dispensing devices are available, there still exists a need for an improved device for dispensing carbonated beverages from a container.

SUMMARY OF THE INVENTION

The present invention addresses the foregoing needs by providing an improved beverage dispensing device.

One aspect of the invention includes a container defining a first enclosed space for holding a fluid and a pressure regulator in fluid communication with the first enclosed space. The pressure regulator includes a second enclosed space and a sorbent contained within the second enclosed space. The sorbent has a propellant gas adsorbed to the sorbent.

In addition, this aspect of the invention includes an inlet in fluid communication with the first enclosed space and the second enclosed space. The inlet includes a flow regulator wherein the opening and closing of the flow regulator is controlled by the pressure of the fluid. Finally, this aspect of the invention includes an outlet in fluid communication with the second enclosed space and the first enclosed space.

When the pressure of the fluid in the first enclosed space is reduced, the flow regulator opens, allowing the fluid to flow into the pressure regulator. As the fluid contacts the sorbent, it liberates the propellant gas, which is then released through the outlet, restoring pressure to the fluid. As pressure is restored in the fluid, the flow regulator closes, and no more propellant is liberated.

A second aspect of the invention includes a container defining a first enclosed space for holding a fluid and a pressure regulator in fluid communication with the first enclosed space. In this aspect of the invention, the pressure regulator includes a second enclosed space containing a sorbent on which is adsorbed a propellant gas and a third enclosed space for holding a displacing agent. This aspect of the invention includes an inlet to the second enclosed space is in fluid communication with both the second enclosed space and the third enclosed space. The inlet includes a flow regulator wherein the opening and closing of the flow regulator is controlled by the pressure inside the first enclosed space. In addition, this aspect of the invention includes an outlet from the second enclosed space in fluid communication with the second enclosed space and the first enclosed space.

When the pressure of the fluid in the first enclosed space is reduced, the flow regulator opens, allowing the displacing agent to flow from the third enclosed space to the second enclosed space. As the displacing agent contacts the sorbent, it liberates the propellant gas, which is then released through the outlet, restoring pressure to the fluid. As pressure is restored in the fluid, the flow regulator closes, and no more propellant is liberated.

A third aspect of the invention is a method for dispensing a beverage using the fluid dispensing device. The fluid dispensing device maintains pressure in the fluid as the fluid is dispensed out of the device, allowing one to dispense a beverage continuously as it is being dispensed.

It is therefore an advantage of the invention to maintain the pressure of the beverage being dispensed so that the pressure inside the dispensing device does not have to be continuously recharged manually through pumping or through providing an external pressure source.

It is another advantage of the invention to maintain the pressure of the beverage being dispensed so that the beverage can be continuously and easily dispensed through dispensing means that depend on the pressure of the beverage for successful dispensing.

It is another advantage of the invention provide a simple and inexpensive mechanism integrated into the dispensing device to maintain the pressure of the beverage being dispensed, so that consumers can dispense beverages without the cost, inconvenience, and bulkiness of means of maintaining pressure.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DESCRIPTION OF THE INVENTION

Figure 1:
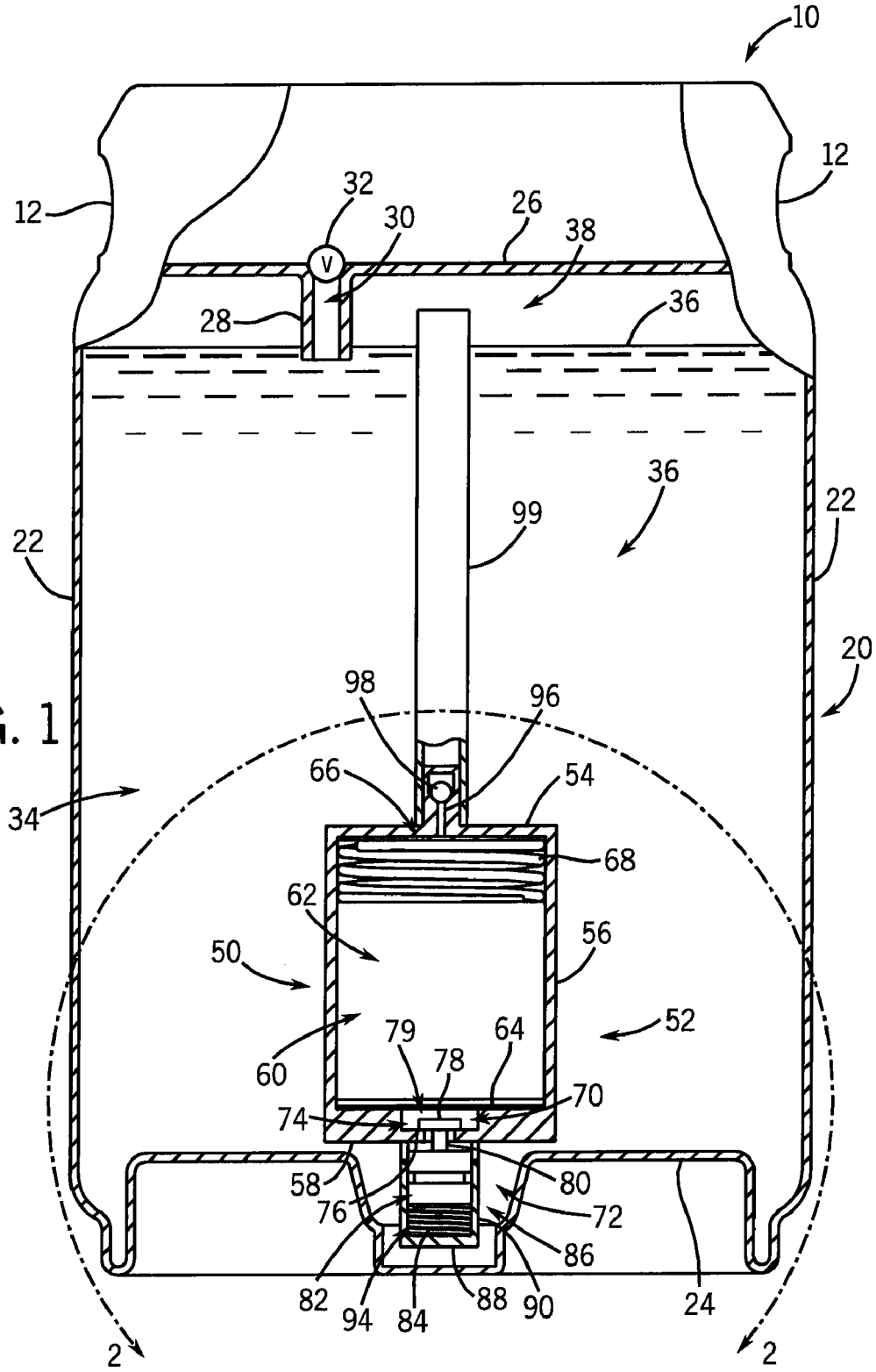
FIG. 1 is a side sectional view of one embodiment of a fluid dispensing device according to the invention.
Figure 2:
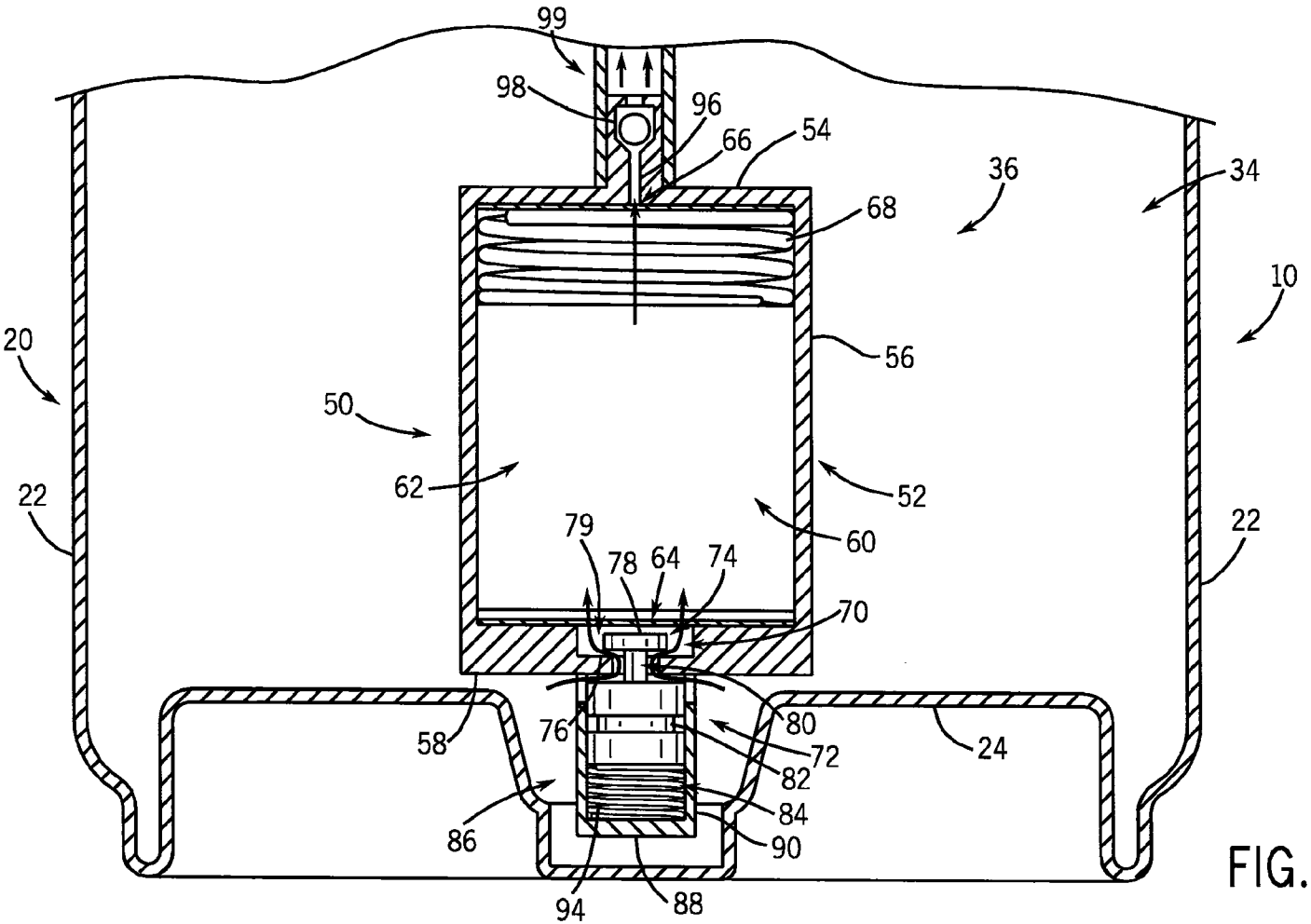
FIG. 2 is a detailed view taken along line 2-2 of FIG. 1.

Looking first at FIGS. 1 and 2, there is shown one example embodiment of a fluid dispensing device according to the invention.

The device 10 includes a container 20, and optionally includes one or more handles 12. Handles 12 may be attached to the container 20 by any known means in order to make it easier to carry the device 10. The handles 12 may be of any type.

The container 20 is defined by a side wall 22, a base wall 24 at the bottom allowing the container to be stably placed on a surface, and a top wall 26. The walls are connected together to form a continuous enclosure defining a first enclosed space 34. The walls may be constructed of any material (such as aluminum or steel) capable of containing a liquid and capable of remaining rigid and impervious to fluids at pressures greater than normal atmospheric pressure. In the normal operation of the device 10, the first enclosed space 34 contains a fluid 36. In one embodiment, the fluid is a carbonated beverage. In another embodiment, the fluid is a malt beverage. Above the fluid 36 is the head space 38. The head space 36 is the space remaining within the first enclosed space 34 that is not occupied by the either the fluid 36 or the pressure regulator 50.

The top wall 26 contains a single opening 30 through which the inside and outside of the container 20 are in fluid communication. A down tube 28, an open cylindrical tube, extends downward into the container 20 from the opening 30. A dispensing valve 32 controls the flow of fluid from the inside to the outside of the container 20 through the opening 30, and may be of any valve type commonly used in the art for this purpose.

The device 10 may also include a dispensing means extending into the container 20 through the opening 30, such as a dip tube commonly used in beverage dispensing devices. In addition, as the fluid 36 flows through the dispensing valve 32, the fluid 36 may be directed outside of the container to a suitable dispensing tap for dispensing the fluid 36.

Within the first enclosed space 34 in this embodiment is a pressure regulator 50. The pressure regulator 50 includes a hollow cylindrical body 52 having a top wall 54, a side wall 56, and a bottom wall 58. The walls 54, 56, 58 are connected together to form a continuous enclosure defining a second enclosed space 60. The walls 54, 56, 58 may be constructed of any material capable of containing a liquid and capable of remaining rigid and impervious to fluids at pressures greater than normal atmospheric pressure.

The bottom wall 58 of the hollow cylindrical body 52 includes an inlet 70 in fluid communication with the first enclosed space 34 and the second enclosed space 60. Fluid flow through the inlet from the first enclosed space 34 into the second enclosed space 60 is controlled by the flow regulator 72. The opening and closing of the flow regulator 72 is controlled by the pressure within the first enclosed space 34.

The flow regulator 72 contains an inlet valve 74. The inlet valve 74 includes a seat 76 and a disc 78. The disc 78 is an object that functions to fully or partially block the inlet 70 as the inlet valve 74 is closed (as in FIG. 1). Although discs can be disc-shaped, discs can also come in variety of other shapes. The disc 78 in the inlet valve 74 is movable so it can control flow.

The seat 76 is the surface which contacts or could contact the disc to form a seal which should be leak-tight when the inlet valve 74 is shut (closed). The disc 78 moves linearly as the inlet valve 74 is controlled, and comes into contact with the seat 76 when the inlet valve 74 is shut (as in FIG. 1). In contrast, when the inlet valve 74 is opened (as in FIG. 2), the disc 78 moves linearly upward away from the seat 76, allowing fluid flow through the inlet 70.

The disc 78 and seat 76 in the present embodiment are contained within a hollowed out cavity 79 within the bottom wall 58 of the hollow cylindrical body 52. The inlet valve 74 also includes a stem 80 that is connected to the disc 78 and extends downward through the inlet 70. The stem 80 is narrower than the inlet 70 opening, so that when the inlet valve is open (as in FIG. 2), the fluid 36 can flow through the inlet.

The end of the stem 80 extending to the outside of the hollow cylindrical body 52 is attached to a piston 82 engaging a spring 84. The spring 84 is attached to the bottom of an open cylindrical valve body 86 containing a bottom wall 88 and a side wall 90. The bottom of the valve body 86 is embedded in the base wall 24 of the container 20. The piston 82 engages the spring 84 within the valve body 86, creating a sealed space 94 occupied by the spring 84. The sealed space 94 is not exposed to the pressure within the first enclosed space 34.

The upper surface of the piston 82 is subject to the pressure within the first enclosed space 34, but the lower surface of the piston 82 is not. Because of this, the pressure of the first enclosed space 34 exerts a net force pushing downward on the piston 82. This force is transferred through the stem 80 and pushes the disc 78 towards the seat 76. Thus, the pressure within the first enclosed space exerts a force tending to close the inlet valve 74 and prevent flow of fluid 36 from the first enclosed space 34 into the second enclosed space 60.

The lower surface of the piston 82 engages the spring 84, and is subject to the force of the spring 84. Because of this, the force of the spring 84 exerts a net force pushing upward on the piston 82. This force is transferred through the stem 80 and pushes the disc 78 away from the seat 76. Thus, the spring 84 exerts a force tending to open the inlet valve 74 and allow the flow of fluid 36 from the first enclosed space 34 into the second enclosed space 60.

When the first enclosed space 34 of the container 20 is filled with a carbonated beverage at a higher pressure, the pressure within the first enclosed space 34 pushing the piston 82 downward is greater than the force of the spring 84 pushing the piston 82 upward, and the inlet valve 74 is closed, preventing fluid 36 flow from the first enclosed space 34 into the second enclosed space 60. If the pressure within the first enclosed space 34 decreases, the pressure within the first enclosed space 34 pushing the piston 82 downward can become less than the force of the spring 84 pushing the piston 82 upward, and the inlet valve 74 is opened, allowing fluid 36 to flow from the first enclosed space 34 into the second enclosed space 60.

The second enclosed space 60 is substantially filled with a sorbent 62 to which a propellant gas is adsorbed. A sorbent is a highly porous adsorbent solid that is capable of adsorbing and holding on its surface substantial quantities of a propellant gas. Examples of sorbents well known in the art include silica and activated carbon. Zeolites (alumino-silicates) in the form of solids, crystalline granules, or beads are the preferred sorbents for this embodiment. One example of a commercially available zeolite that could be used in this embodiment is the Molecular Sieve (molecular formula $Na_{86}[(AlO_2)_{86}(SiO_2)_{106}]xH_2O$), 13×8-12 mesh beads, available from Sigma-Aldrich of St. Louis, Mo.

In the process of charging, which is well-known in the art, the propellant gas is adsorbed to the pores on the surface of the sorbent particles. Possible propellant gases include lower alkanes such as propane or butane. Because the present embodiment is designed to dispense carbonated beverages, the preferred propellant gas is carbon dioxide. Carbon dioxide is inexpensive, is a safe ingredient commonly contained in beverages and food products, and is readily adsorbed onto sorbents such as activated carbon, silicates, and zeolites. In addition, adsorbed carbon dioxide is readily displaced and released from these sorbents when a displacing agent is added to the sorbent.

A displacing agent is a material which acts on a sorbent on which a propellant gas is adsorbed to release the propellant gas. Water and mixtures containing large amounts of water are effective displacing agents. It is cheap and readily available, and can be used with activated carbon, silica, and zeolite sorbents. In addition, it is the major ingredient of carbonated and malt beverages, meaning that the fluid in the dispenser in this embodiment could be used as the displacing agent.

When the dispensing device 10 has first been filled with the fluid 36 to be dispensed, the pressure within the first enclosed space 34 is typically about 10-20 psig, most preferably about 16 psig. The inlet valve 74 remains closed, no displacing agent is in contact with the sorbent 62, and no propellant gas is released from the sorbent 62. As the fluid 36 is dispensed, the pressure within the first enclosed space 34 is reduced as the fluid 36 is removed. The reduced pressure in the first enclosed space 34 allows the force of the spring 84 on the piston 82 to overcome the pressure within the first enclosed space 34 against the piston 82, and the inlet valve 74 opens.

When the inlet valve 74 opens, the fluid 36 enters the second enclosed space 60. Before entering the second enclosed space 60, the fluid 36 passes through a first membrane 64, which is a filter that prevents sediments and solids from entering the second enclosed space 60. The first membrane 64 can be made of a variety of material well-known in the art for filtering liquids.

After passing through the first membrane 64, the fluid contacts the sorbent 62 containing the adsorbed propellant gas. Because the fluid 36 is largely water, it is an effective displacing agent, and causes some of the propellant gas to be released from the sorbent 62. The second enclosed space 60 may contain an anti-foaming spring 68 in the portion of the space that is not filled with sorbent 62. The anti-foaming spring 68 lessens the effect of foaming within the second enclosed space 60 as propellant gas is released from the sorbent 62. An anti-foaming spring 68 is not required if the second enclosed space 60 is completely filled with the sorbent 62.

As the propellant gas is released from the sorbent 62, pressure increases in the second enclosed space 60. Excess gas flows through an outlet 96 in fluid communication with the first enclosed space 34 and the second enclosed space 60. The propellant gas passes through the outlet 96 into the first enclosed space 34.

As the propellant gas is liberated from the sorbent 62 and passes into the first enclosed space 34, the pressure within the first enclosed space 34 increases. At a given point, the increased pressure within the first enclosed space 34 against the piston 82 is greater than the force of the spring 84 on the piston 82, and the inlet valve 74 closes. After the inlet valve 74 closes, no more displacing agent enters the second enclosed space to contact the sorbent 62, and the liberation of propellant gas from the sorbent 62 stops. As more fluid 36 is dispensed, the pressure within the first enclosed space 34 again decreases, and the whole process is repeated. This repeated process insures a uniform pressure within the first enclosed space 34 for continuous beverage dispensing.

Before passing through the outlet 96, gasses and fluids pass through a second membrane 66. The second membrane 66, like the first membrane 64, may be a simple filter for removing solids and sediments. Alternatively, the second membrane 66 may be a hydrophobic membrane. A hydrophobic membrane, which is well-known in the art, would allow the flow of propellant gas through the second membrane 66 and the outlet 96 while preventing the flow of liquids (such as the beverage being dispensed) through the second membrane 66 and the outlet 96. This would prevent any beverage that had been in contact with the sorbent from being dispensed for consumption.

The outlet 96 contains a check valve 98 to ensure one-way flow of fluid through the outlet 96 from the second enclosed space 60 to the first enclosed space 34. Thus, no fluid 36 can contact the sorbent 62 without passing through the flow regulator 72, which is controlled solely by the pressure within the first enclosed space 34.

A hollow cylindrical pipe 99 in fluid communication with the second enclosed space 60 and the first enclosed space 34 extends from the check valve 98 to the head space 38. The pipe 99 prevents backflow of fluid into the check valve 98, and directs excess propellant gas to the head space 38, where it will increase the pressure within the first enclosed space 34 to assist in beverage dispensing.

Figure 3:
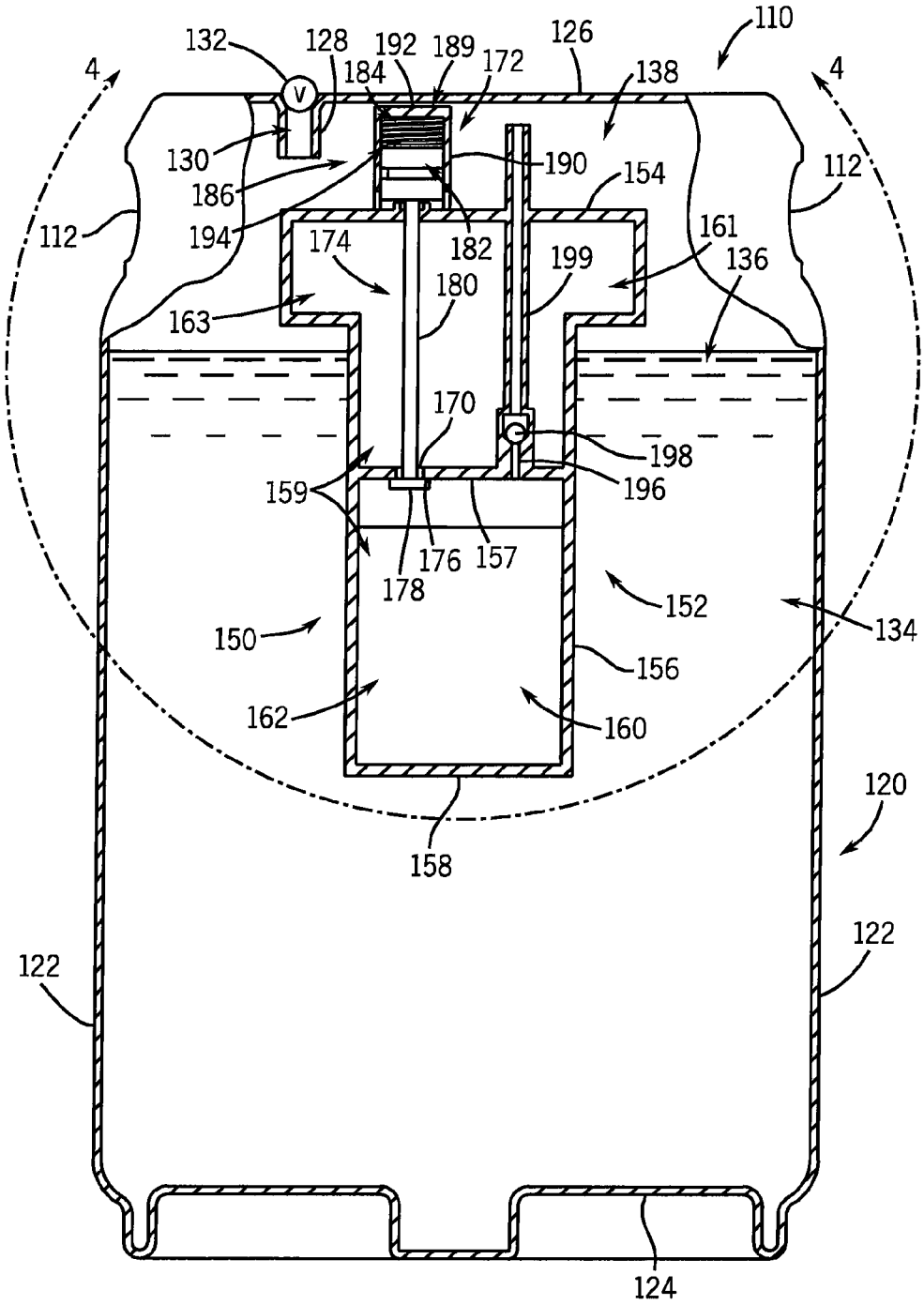
FIG. 3 is a side sectional view of another embodiment of a fluid dispensing device according to the invention.
Figure 4:
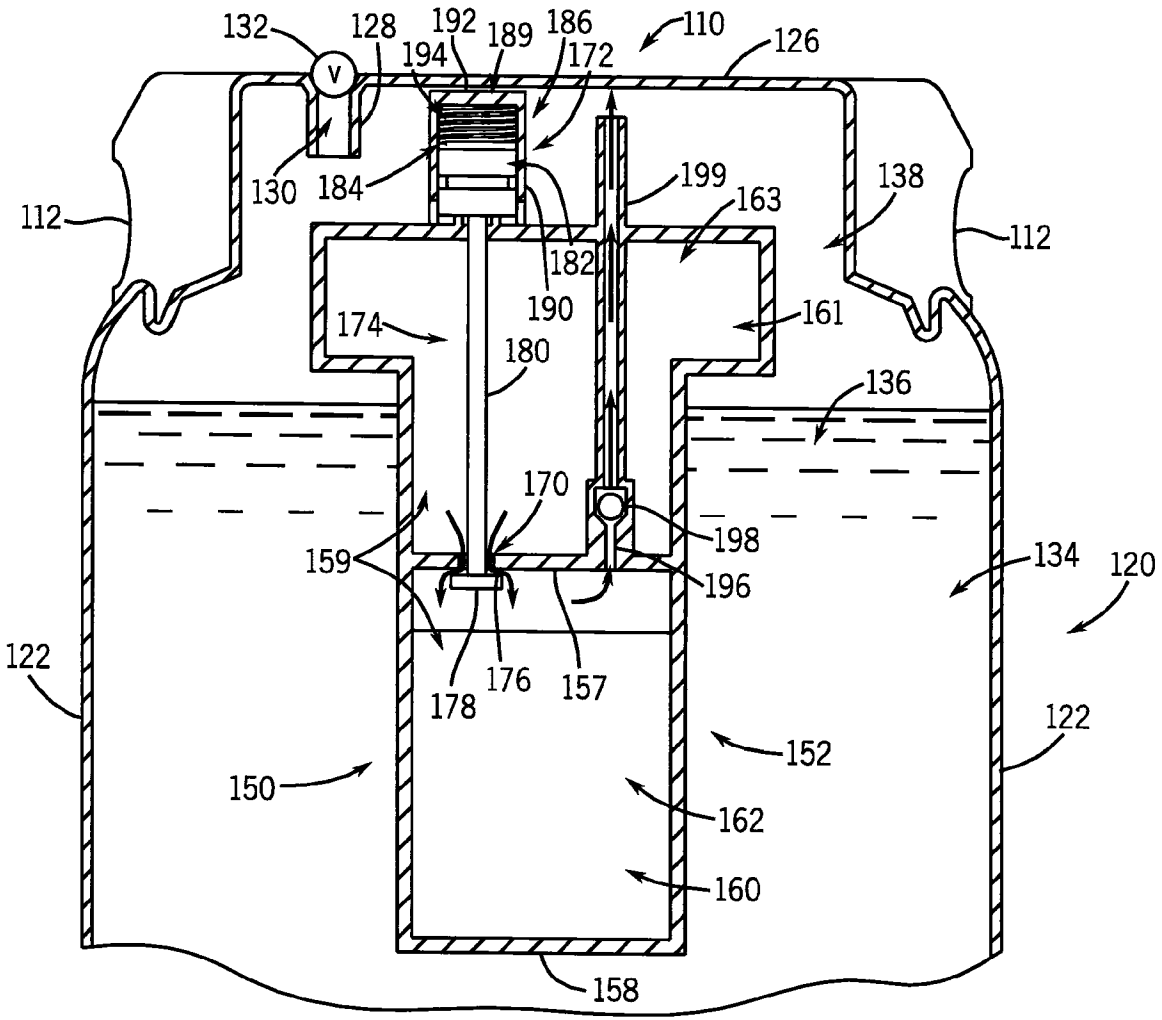
FIG. 4 is a detailed view taken along line 4-4 of FIG. 3.

Turning now to FIGS. 3 and 4, there is shown another example embodiment of a fluid dispensing device according to the invention.

The device 110 includes a container 120, and optionally includes one or more handles 112. Handles 112 may be attached to the container 120 by any known means in order to make it easier to carry the device 110. The handles 112 may be of any type.

The container 120 is defined by a side wall 122, a base wall 124 at the bottom allowing the container to be stably placed on a surface, and a top wall 126. The walls are connected together to form a continuous enclosure defining a first enclosed space 134. The walls may be constructed of any material (such as aluminum or steel) capable of containing a liquid and capable of remaining rigid and impervious to fluids at pressures greater than normal atmospheric pressure. In the normal operation of the device 110, the first enclosed space 134 contains a fluid 136. In one embodiment, the fluid is a carbonated beverage. In another embodiment, the fluid is a malt beverage. Above the fluid 136 is the head space 138. The head space 136 is the space remaining within the first enclosed space 134 that is not occupied by the either the fluid 136 or the pressure regulator 150.

The top wall 126 contains a single opening 130 through which the inside and outside of the container 120 are in fluid communication. A down tube 128, an open cylindrical tube, extends downward into the container 120 from the opening 130. A dispensing valve 132 controls the flow of fluid from the inside to the outside of the container 120 through the opening 130, and may be of any valve type commonly used in the art for this purpose.

The device 110 may also include a dispensing means extending into the container 120 through the opening 130, such as a dip tube commonly used in beverage dispensing devices. In addition, as the fluid 136 flows through the dispensing valve 132, the fluid 136 may be directed outside of the container to a suitable dispensing tap for dispensing the fluid 136.

Within the first enclosed space 134 in this embodiment is a pressure regulator 150. The pressure regulator 150 includes a hollow substantially cylindrical body 152 having a top wall 154, a side wall 156, and a bottom wall 158. The walls 154, 156, 158 are connected together to form an enclosure 159. The enclosure 159 is divided into two chambers 159 by a dividing wall 157. The lower chamber defines a second enclosed space 160, and the upper chamber defines a third enclosed space 161. The walls may be constructed of any material capable of containing a liquid and capable of remaining rigid and impervious to fluids at pressures greater than normal atmospheric pressure.

The dividing wall 157 of the substantially hollow cylindrical body 152 includes an inlet 170 in fluid communication with the third enclosed space 161 and the second enclosed space 160. The third enclosed space contains a pressurized displacing agent 163. In this embodiment, the preferred displacing agent is water.

Displacing agent flow through the inlet from the third enclosed space 161 into the second enclosed space 160 is controlled by the flow regulator 172. The opening and closing of the flow regulator 172 is controlled by the pressure within the first enclosed space 134.

The flow regulator 172 contains an inlet valve 174. The inlet valve 174 includes a seat 176 and a disc 178. The disc 178 is an object that functions to fully or partially block the inlet 170 as the inlet valve 174 is closed (as in FIG. 3). Although discs can be disc-shaped, discs can also come in variety of other shapes. The disc 178 in the inlet valve 174 is movable so it can control flow.

The seat 176 is the surface which contacts or could contact the disc to form a seal which should be leak-tight when the inlet valve 174 is shut (closed). The disc 178 moves linearly as the inlet valve 174 is controlled, and comes into contact with the seat 176 when the inlet valve 174 is shut (as in FIG. 3). In contrast, when the inlet valve 174 is opened (as in FIG. 4), the disc 178 moves linearly downward away from the seat 176, allowing fluid flow through the inlet 170.

The inlet valve 174 also includes a stem 180 that is connected to the disc 178 and extends downward through the inlet 170. The stem 180 is narrower than the inlet 170 opening, so that when the inlet valve is open (as in FIG. 4), the fluid 136 can flow through the inlet.

The end of the stem 180 extending to the outside of the hollow substantially cylindrical body 152 is attached to a piston 182 engaging a spring 184. The spring 184 is attached to the top of a fixed open cylindrical valve body 186 containing a top wall 189 and a side wall 190. The top of the valve body 186 is attached to the top wall 126 of the container 120. The piston 182 engages the spring 184 within the valve body 186, creating a sealed space 194 occupied by the spring 184. The sealed space 194 is not exposed to the pressure within the first enclosed space 134.

The lower surface of the piston 182 is subject to the pressure within the first enclosed space 134, but the upper surface of the piston 182 is not. Because of this, the pressure of the first enclosed space 134 exerts a net force pushing upward on the piston 182. This force is transferred through the stem 180 and pushes the disc 178 towards the seat 176. Thus, the pressure within the first enclosed space exerts a force tending to close the inlet valve 174 and prevent flow of the displacing agent 163 from the third enclosed space 161 into the second enclosed space 160.

The upper surface of the piston 182 engages the spring 184, and is subject to the force of the spring 184. Because of this, the force of the spring 184 exerts a net force pushing downward on the piston 182. This force is transferred through the stem 180 and pushes the disc 178 away from the seat 176. Thus, the spring 184 exerts a force tending to open the inlet valve 174 and allow the flow of the displacing agent 163 from the third enclosed space 161 into the second enclosed space 160.

When the first enclosed space 134 of the container 120 is filled with a carbonated beverage at a higher pressure, the pressure within the first enclosed space 134 pushing the piston 182 downward is greater than the force of the spring 184 pushing the piston 182 upward, and the inlet valve 174 is closed, preventing displacing agent 163 flow from the third enclosed space 161 into the second enclosed space 160. If the pressure within the first enclosed space 134 decreases, the pressure within the first enclosed space 134 pushing the piston 182 upward can become less than the force of the spring 184 pushing the piston 182 downward, and the inlet valve 174 is opened, allowing the displacing agent 163 to flow from the third enclosed space 161 into the second enclosed space 160.

The second enclosed space 160 is substantially filled with a sorbent 162 to which a propellant gas is adsorbed. A sorbent is a highly porous adsorbent solid that is capable of adsorbing and holding on its surface substantial quantities of a propellant gas. Examples of sorbents well known in the art include silica and activated carbon. Zeolites (alumino-silicates) in the form of solids, crystalline granules, or beads are the preferred sorbents for this embodiment. One example of a commercially available zeolite that could be used in this embodiment is the Molecular Sieve (molecular formula $Na_{86}[(AlO_2)_{86}(SiO_2)_{106}].xH_2O$), 13×8-12 mesh beads, available from Sigma-Aldrich of St. Louis, Mo.

In the process of charging, which is well-known in the art, the propellant gas is adsorbed to the pores on the surface of the sorbent particles. Possible propellant gases include lower alkanes such as propane or butane. Because the present embodiment is designed to dispense carbonated beverages, the preferred propellant gas is carbon dioxide. Carbon dioxide is inexpensive, is a safe ingredient commonly contained in beverages and food products, and is readily adsorbed onto sorbents such as activated carbon, silicates, and zeolites. In addition, adsorbed carbon dioxide is readily displaced and released from these sorbents when a displacing agent is added to the sorbent.

A displacing agent is a material which acts on a sorbent on which a propellant gas is adsorbed to release the propellant gas. Water is an effective displacing agent. It is cheap and readily available, and can be used with activated carbon, silica, and zeolite sorbents. In this embodiment, the displacing agent 63 is pressurized water.

When the dispensing device 110 has first been filled with the fluid 136 to be dispensed, the pressure within the first enclosed space 134 is typically about 10-20 psig, most preferably about 16 psig. The inlet valve 174 remains closed, no displacing agent is in contact with the sorbent 162, and no propellant gas is released from the sorbent 162. As the fluid 136 is dispensed, the pressure within the first enclosed space 134 is reduced as the fluid 136 is removed. The reduced pressure in the first enclosed space 134 allows the force of the spring 184 on the piston 182 to overcome the pressure within the first enclosed space 134 against the piston 182, and the inlet valve 174 opens.

When the inlet valve 174 opens, the displacing agent 163 enters the second enclosed space 160. The displacing agent 163 contacts the sorbent 162 containing the adsorbed propellant gas. The displacing agent 163 causes some of the propellant gas to be released from the sorbent 162.

As the propellant gas is released from the sorbent 162, pressure increases in the second enclosed space 160. Excess gas flows through an outlet 196 in fluid communication with the first enclosed space 134 and the second enclosed space 160. The propellant gas passes through the outlet 196 into the first enclosed space 134.

As the propellant gas is liberated from the sorbent 162 and passes into the first enclosed space 134, the pressure within the first enclosed space 134 increases. At a given point, the increased pressure within the first enclosed space 134 against the piston 182 is greater than the force of the spring 184 on the piston 182, and the inlet valve 174 closes. After the inlet valve 174 closes, no more displacing agent enters the second enclosed space to contact the sorbent 162, and the liberation of propellant gas from the sorbent 162 stops. As more fluid 136 is dispensed, the pressure within the first enclosed space 134 again decreases, and the whole process is repeated. This repeated process insures a uniform pressure within the first enclosed space 134 for continuous beverage dispensing.

Before passing through the outlet 196, gasses and fluids may optionally pass through a hydrophobic membrane. A hydrophobic membrane, which is well-known in the art, would allow the flow of propellant gas through the outlet 196 while preventing the flow of liquids (such as the displacing agent) through the outlet 196. This would prevent any water being used as a displacing agent from contacting and diluting the fluid being dispensed.

The outlet 196 contains a check valve 198 to ensure one-way flow of fluid through the outlet 196 from the second enclosed space 160 to the first enclosed space 134. Thus, no fluid 136 can contact the sorbent 162. Only the displacing agent passing through the flow regulator 172, which is controlled solely by the pressure within the first enclosed space 134, can contact the sorbent 162.

A hollow cylindrical pipe 199 in fluid communication with the second enclosed space 160 and the first enclosed space 134 extends from the check valve 198 to the head space 138. The pipe 199 prevents backflow of fluid into the check valve 198, and directs excess propellant gas to the head space 138, where it will increase the pressure within the first enclosed space 134 to assist in beverage dispensing.

Although the present invention has been described in detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention provides devices for dispensing carbonated beverages.

What is claimed is:

1. A fluid dispensing device comprising:

a. a container defining a first enclosed space for holding a fluid; and b. a pressure regulator in fluid communication with the first enclosed space, the pressure regulator comprising:

(i) a second enclosed space;

(ii) a sorbent contained within the second enclosed space, the sorbent further comprising a propellant gas adsorbed to the sorbent;

(iii) an inlet in fluid communication with the first enclosed space and the second enclosed space;

(iv) the inlet comprising a flow regulator wherein the opening and closing of the flow regulator is controlled by the pressure within the first enclosed space; and (v) an outlet in fluid communication with the second enclosed space and the first enclosed space, the outlet including a check valve having a position allowing a flow of propellant gas released from the sorbent from the second enclosed space to the first enclosed space.

2. The fluid dispensing device of claim 1 wherein the check valve prevents fluid flow from the container into the pressure regulator.

3. The fluid dispensing device of claim 1 wherein the outlet further comprises a hydrophobic membrane permeable to gases but not permeable to liquids.

4. The fluid dispensing device of claim 1 wherein the outlet further comprises a pipe in fluid communication with the second enclosed space and a head space, the head space being the space between the top of the fluid and the top of the first enclosed space.

5. The fluid dispensing device of claim 1 wherein the sorbent comprises a zeolite.

6. The fluid dispensing device of claim 1 wherein the propellant is carbon dioxide.

7. The fluid dispensing device of claim 1 wherein the fluid comprises a carbonated beverage.

8. The fluid dispensing device of claim 1 wherein the fluid is a malt beverage.

9. The fluid dispensing device of claim 1 wherein the flow regulator comprises an inlet valve.

10. The fluid dispensing device of claim 7 wherein the inlet valve further comprises:

a. a seat comprising a surface bordering an opening between the second enclosed space and the first enclosed space;

b. a moveable disc which covers the opening when the disc is in contact with the seat;

c. a piston connected to the disc with a stem, the piston being exposed to the pressure of the first enclosed space such that the pressure exerts a force pushing the disc towards the seat; and d. a spring engaging the piston and exerting a force pushing the disc away from the seat.

11. The fluid dispensing device of claim 1 wherein the pressure regulator further comprises a spring contained in the second enclosed space.

12. A fluid dispensing device comprising:

a. a container defining a first enclosed space for holding a fluid; and b. a pressure regulator in fluid communication with the first enclosed space, the pressure regulator comprising:
(i) a second enclosed space;
(ii) a sorbent contained within the second enclosed space, the sorbent further comprising a propellant gas adsorbed to the sorbent;
(iii) a third enclosed space for holding a displacing agent;
(iv) an inlet to the second enclosed space in fluid communication with both the second enclosed space and the third enclosed space;
(v) the inlet comprising a flow regulator wherein the opening and closing of the flow regulator is controlled by the pressure within the first enclosed space; and
(vi) an outlet from the second enclosed space in fluid communication with the second enclosed space and the first enclosed space.

13. The fluid dispensing device of claim 12 wherein the outlet further comprises a check valve preventing fluid flow from the container into the pressure regulator.

14. The fluid dispensing device of claim 12 wherein the outlet further comprises a hydrophobic membrane permeable to gases but not permeable to liquids.

15. The fluid dispensing device of claim 12 wherein the outlet further comprises a pipe in fluid communication with the second enclosed space and a head space, the head space being the space between the top of the fluid and the top of the first enclosed space.

16. The fluid dispensing device of claim 12 wherein the sorbent comprises a zeolite.

17. The fluid dispensing device of claim 12 wherein the propellant is carbon dioxide.

18. The fluid dispensing device of claim 12 wherein the fluid comprises a carbonated beverage.

19. The fluid dispensing device of claim 12 wherein the fluid is a malt beverage.

20. The fluid dispensing device of claim 12 wherein the flow regulator comprises an inlet valve.

21. The fluid dispensing device of claim 12 wherein the inlet valve further comprises:
a. a seat comprising a surface bordering an opening between the second enclosed and the first enclosed space;
b. a moveable disc which covers the opening when the disc is in contact with the seat;
c. a piston connected to the disc with a stem, the piston being exposed to the pressure of the first enclosed space such that the pressure exerts a force pushing the disc towards the seat; and
d. a spring engaging the piston and exerting a force pushing the disc away from the seat.

22. The fluid dispensing device of claim 12 wherein the third enclosed space contains pressurized water.

23. A method of dispensing a fluid comprising the steps of:
a. providing a container defining a first enclosed space for holding a fluid;
b. adding a fluid to the first enclosed space;
c. providing a pressure regulator in fluid communication with the fluid, the pressure regulator comprising:
(i) a second enclosed space
(ii) a sorbent contained within the second enclosed space, the sorbent further comprising a propellant gas adsorbed to the sorbent;
(iii) an inlet in fluid communication with the first enclosed space and the second enclosed space;
(iv) the inlet comprising a flow regulator wherein the opening and closing of the flow regulator is controlled by the pressure within the first enclosed space; and
(v) an outlet in fluid communication with the second enclosed space and the first enclosed space, the outlet including a check valve having a position allowing a flow of propellant gas released from the sorbent from the second enclosed space to the first enclosed space; and
d. providing a second outlet from the first enclosed space in fluid communication with the fluid and the outside of the container; and
e. opening the second outlet to dispense the fluid from the inside to the outside of the container.

24. The method of claim 23 wherein the fluid is a carbonated beverage.

25. The method of claim 23 wherein the fluid is a malt beverage.

* * * * *